US006314701B1

(12) United States Patent
Meyerson

(10) Patent No.: US 6,314,701 B1
(45) Date of Patent: Nov. 13, 2001

(54) CONSTRUCTION PANEL AND METHOD

(76) Inventor: Steven C. Meyerson, 2543 Redwood Way, Clearwater, FL (US) 34621

( * ) Notice: Subject to any disclaimer, the term of this patent is extended or adjusted under 35 U.S.C. 154(b) by 0 days.

(21) Appl. No.: 09/247,777

(22) Filed: Feb. 9, 1999

Related U.S. Application Data

(60) Provisional application No. 60/078,746, filed on Feb. 9, 1998.

(51) Int. Cl.[7] ..... E04B 1/00

(52) U.S. Cl. ..... 52/588.1; 52/309.9; 52/589.1; 52/592.1

(58) Field of Search ..... 52/309.9, 309.7, 52/309.11, 309.4, 309.8, 588.1, 586.1, 592.1, 586.2, 579.1, 572.4

(56) References Cited

U.S. PATENT DOCUMENTS

| | | | |
|---|---|---|---|
| 2,284,229 | | 5/1942 | Palmer . |
| 2,682,938 | | 7/1954 | MacDonald . |
| 3,293,812 | | 12/1966 | Hammitt . |
| 3,331,173 | | 7/1967 | Elsner . |
| 3,367,076 | | 2/1968 | O'Brien . |
| 3,479,784 | | 11/1969 | Massagli . |
| 3,742,672 | | 7/1973 | Schaeufele . |
| 3,760,548 | | 9/1973 | Sauer et al. . |
| 3,854,260 | | 12/1974 | O'Hanlon . |
| 4,186,539 | | 2/1980 | Harmon et al. . |
| 4,373,312 | | 2/1983 | Kim . |
| 4,438,614 | | 3/1984 | Raith et al. . |
| 4,486,994 | | 12/1984 | Fisher et al. . |
| 4,748,783 | | 6/1988 | L'abelle . |
| 4,754,587 | | 7/1988 | Glaser . |
| 4,769,963 | | 9/1988 | Meyerson . |
| 5,086,599 | * | 2/1992 | Meyerson ..... 52/309.9 |
| 5,092,095 | * | 3/1992 | Zadok et al. ..... 52/588.1 |
| 5,343,665 | * | 9/1994 | Palmersten ..... 52/588.1 |
| 5,448,865 | * | 9/1995 | Palmersten ..... 52/588.1 X |
| 5,502,939 | * | 4/1996 | Zadok et al. ..... 52/592.1 X |

FOREIGN PATENT DOCUMENTS

| | | |
|---|---|---|
| 2444762 | 7/1980 | (FR) . |
| 1066701 | 4/1967 | (GB) . |
| 2142670 | 1/1985 | (GB) . |
| 2168732 | 6/1986 | (GB) . |

* cited by examiner

*Primary Examiner*—Richard Chilcot
(74) *Attorney, Agent, or Firm*—R. M. Saccocio

(57) ABSTRACT

An improved construction panel is diclosed comprising a foam core with thin metal skins attached to top and bottom surfaces of the foam core having am improved snap together joint. The joint includes a sealant pocket and stabilizing members. The sealant pocket further includes a bead or a protrusion to positively define a vertical sealant space between adjacent and connected construction panels.

6 Claims, 2 Drawing Sheets

CONSTRUCTION PANEL AND METHOD

CROSS REFERENCE TO RELATED APPLICATIONS

This application claims the benefit of U.S. Provisional Application No. 60/078,746, filed Feb. 9, 1998

BACKGROUND OF THE INVENTION a) Field of the Invention

This invention relates in general to the field of building panels for such use as roofing, interior or exterior walls, even entire buildings and in particular to building panels having an insulating core and structural and/or weather resistant exterior surfaces, said building panels being sealingly joinable along at least one edge.

b) Description of the Prior Art

Foam core building panels are relatively well known in the prior art. They comprise a sandwich construction having a foam insulating core with structural skins permanently bonded to the exterior surfaces of the foam. Typically, the foam core is approximately three (3) inches thick although a thickness of up to eight (8) inches is becoming increasingly popular. The skins may be aluminum, steel, plywood or any other appropriate structural material. Where the building panels incorporate metal skins, the metal skins average approximately 0.019 to 0.032 inches thick. The outer surfaces may be decorated in any manner conceivable, but typically the metal skins are embossed and painted to present a relatively smooth and aesthetically pleasing appearance. The panels generally average four (4) to eight (8) feet wide by eight (8) to forty (40) feet in length. Of course, these are just typical dimensions which have found acceptance in the building industry.

The foam core provides excellent thermal insulating properties while being very light in weight. The exterior skins are permanently bonded to the foam core and even though they are relatively thin they provide a high degree of structural strength to the panels and further provide a surface capable of withstanding severe weather conditions. One can readily imagine the many possible uses for building panels having so many excellent properties. For example, they can be used for walls, both interior or exterior, ceilings, roofs, partitions, tables, doors, columns, building facades, marquees, buildings, etc. However, in the early prior art the foam core building panels have found limited use where they were primarily used for porch roofs and refrigeration buildings. The limited use of the early prior art foam core building panels has been because of the difficulty of joining together adjacent panels and being able to seal the joint. Because of these basic deficiencies, it is understandable that developed uses for the early prior art foam panels was at a standstill.

Upon reviewing the early prior art one sees that there are methods and apparatus used to join together adjacent foam core panels and that they are extremely varied. However, virtually none of the early prior art methods and apparatus used to join the panels were or are in commercial usage. The ostensible reason being that the prior art methods and apparatus did not work when applied to actual construction conditions. For example, the relatively long length of the panels in combination with the relatively thin outer surfaces of the panels does not permit precise end configurations, and therefore does not allow the panels to fit together as envisioned in the prior art drawings. The prior art drawings are two dimensional which conceptually provide for a proper joint; but, under construction conditions, the long length of the panels comprises a third dimension which is not provided for in the prior art drawings. Thus, while the prior art configurations might fit together on paper, the fit up along the entire length of the panels could not be accomplished. But of course, for a satisfactory building panel the entire length of all the panels must be capable of being joined and sealed under actual conditions. Then too, many of the early prior art methods and apparatus were too cumbersome or too complicated to be commercially feasible.

In the prior art therefore, the primary method used to join panels at the point of assembly or at the construction site was to use metal or vinyl splines which fit between formed and extending metal edges of adjacent panels. The splines extended the full length of the edge of the panels which typically is between eight to twenty feet in length and because of this, it was required that the splines be very loosely fitted. A tightly fitting spline could not be slid along the entire length of the panel, it would jam somewhere along the length when being installed. A pair of splines were usually used at each joined joint; one on one side of the panel and another on the other side of the panel. The procedure would be to place two panels side by side, then to fit a spline between the formed and extending edges of the exterior surfaces of one side of both panels and to insert the spline in the direction of the panel length to progressively join one side of the exterior surfaces. A second spline would then be similarly installed on the other side of the exterior surfaces. But because of the required looseness of the splines, the result would be two joined panels whereby the joint would be loose and not be sealed against the weather. Another major disadvantage of this type of joint (i.e. using splines) is that a significant open space resulted between the ends of the foam cores of the panels. The uninsulated space caused moisture condensation problems on the underside of the joined panels. Moreover, the resulting joint would have little if any structural integrity and would not add to the overall stiffness of the two joined panels. Needless to say, a loose fitting unsealed joint was not a favorable condition. Various attempts were made to insert a bead of caulk or other sealant between the adjacent panel edges to form a weather tight joint but such attempts were mostly unsuccessful because of the necessity to push the spline in the direction of the joint which resulted in disturbing the bead of caulk.

In various attempts to overcome the deficiencies of the splined together panel joints, the early prior art discloses sundry designs which are intended to be pushed together to form a joint between adjacent panels. However, as stated above, none of these prior art push together joint designs were commercially successful. They were either to complicated to be manufactured, were too expensive or did not form the intended joint when long panels were attempted to be joined. Thus, in the early prior art, the most widely used method of joining the panels was to use the loose fitting splines however unsatisfactory the resulting joint was.

In approximately 1987, the inventor herein conceived, invented, designed and developed mating end configurations for adjacent foam core building panels which successfully overcame the problems of the early prior art and resulted in a snap together joint. That invention changed the foam core panel industry. A subsequent invention improved the snap together joint even more. The use of the splines became obsolete. My inventions snapped together in the field and worked with long panels. Even with these inventions there still were some occasions where the joint was not to this inventor's satisfaction. The sealing provided by my prior inventions could be improved. The present invention addresses that aspect of my snap together joint.

Accordingly a primary object of the present invention is to provide foam construction panels with a push together joint having a positive seal.

Another object of the present invention is to provide foam construction panels with a push together joint having a predictable, predetermined vertical and horizontal space between joined panels while minimizing side to side looseness between adjacent panels with or without a sealant being used.

The above-stated objects as well as other objects which, although not specifically stated, but are intended to be included within the scope the present invention, are accomplished by the present invention and will become apparent from the hereinafter set forth Summary of the Invention, Detailed Description of the Invention, Drawings, and the Claims appended herewith.

SUMMARY OF THE INVENTION

The above objects as well as others are accomplished by the present invention which comprises a push together joint for foam construction panels which provides a discrete space between adjacent panels within which a bead of sealant may be placed. A bead or a small curved protrusion is formed into one of the formed end configurations of a panel within the vertical sealing space and between adjacent panels. The bead positively forms and limits the width of the vertical space assuring proper fit up of adjacent panels and proper compression and distribution of the sealant within the sealant space.

In accordance with the above, there has been summarized the more important features of the present invention in order that the detailed description of the invention as it appears in the below detailed description of the same, may be better understood.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
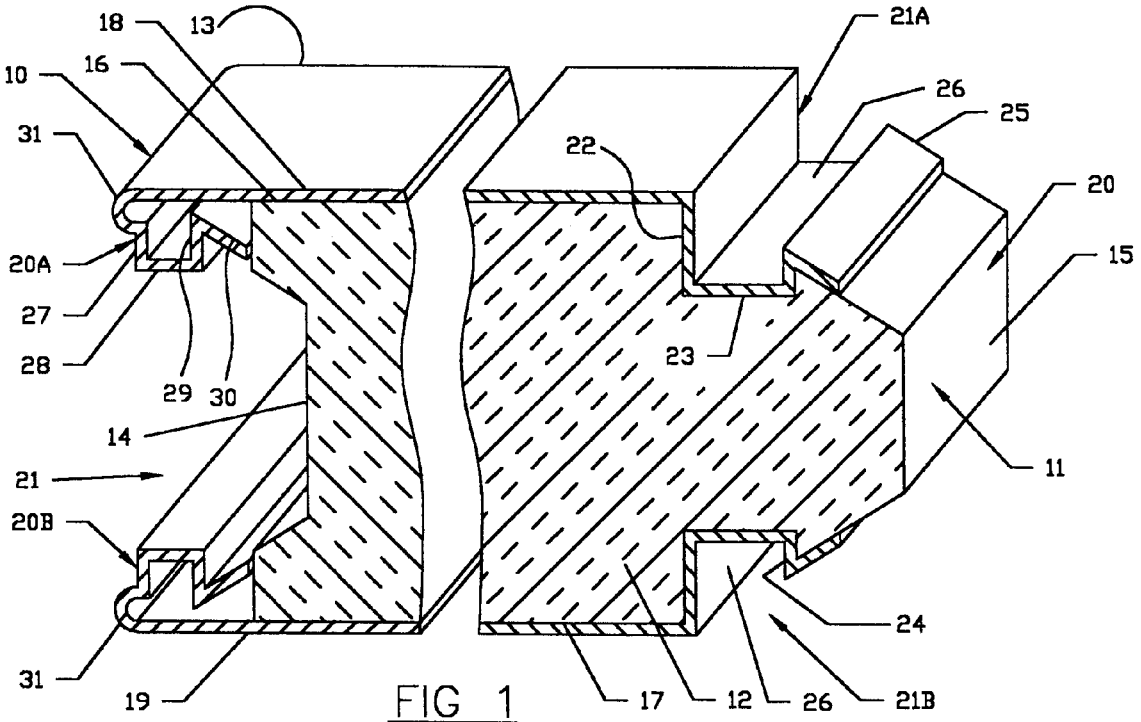
FIG. 1 is a perspective illustration of one constructive panel having a foam core with thin metallic exterior surfaces and formed end configurations according to one embodiment of the present invention.

As required, detailed embodiments of the present invention are disclosed herein; however, it is to be understood that the disclosed embodiments are merely exemplary of the invention which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like the characteristics and features of the present invention shown in the various figures are designated by the same reference numerals.

FIG. 1 shows an isometric view of a construction panel 10 made in accordance with one embodiment of the present invention. The panel 10 comprises a foam core 11 which is made from an insulating material which is relatively rigid such as expanded polystyrene. The foam core includes a front surface 12, a back surface 13 and two side or end surfaces 14 and 15. Side surface 14 of the foam 11 has a female configuration while side surface 15 of the foam has a male configuration. Side surface 15 is configured such that when adjacent panels are arranged side by side, one foam end fits within the other to form an insulating fit. The foam end configurations may be reversed such that end 15 has a female configuration while end 14 has a male configuration; or, the ends may be straight to result in a butt type of fit up.

Referring again to FIG. 1, the top 16 and bottom 17 surfaces of the foam core 11 are covered by metallic cladding 18 and 19 respectively such as aluminum or steel. The metallic cladding 18 and 19 are permanently bonded to the foam core 11. As can be seen, the end configuration of cladding 18 and 19 at side 14 and 15 of the foam core are formed or shaped such that end 20A fits within end 21A and end 20B fits within end 21B when adjacent panels 10 are pushed together.

Ends 21A and 21B each comprises a formed extension of the cladding 18 and 19, respectively, which are formed to fit against the configuration of the end 15 of the foam core. As such, formed ends 21A and 21B each descend at a right angle from the horizontal plane of cladding 18 (or 19) toward the horizontal center of foam core 11, forming edge portion 22. Ends 21A and 21B each then extend at another right angle spaced from but in a direction substanially parallel to the plane of cladding 18 (or 19), forming edge 23 portion. Edge 24 portion is formed at another right angle and extents up or away from the horizontal center of foam core 11, but only for a short distance. Finally end portion 25 extends at a downward angle toward the horizontal center of foam core 11. Edge portion 25 comprises a ramp or sliding surface. The formation of edge portions 22, 23, and 24 form a groove or channel 26 there between.

Ends 20A and 20B are formed in the extending ends of cladding 18 and 19 and are configured to mate or fit with ends 21A and 21B of an adjacent panel. Ends 20A and 20B each comprise a curved portion 31 and a descending edge portion 27. Curved portion 31 may comprise a configuration having the shape of the letter "C" or that of a semi-circle. Descending edge portion 27 is substancially perpendicular to the plane of cladding 18 or 19 and is connected to the end of the curved portion 31 such that curved portion 31 is the outermost extending portion of formed ends 20A and 20B. A horizontal portion 28 is connected to vertical portion 27 and extends back toward the foam of foam core 11. A short vertical portion 29 and an angled end portion 30 complete the configuration of ends 20A and 20B. As seen in FIG. 1 end configurations 20A and 20B extend beyond the end 14 of foam 11 in a cantilevered manner, such that ends 20A and 20B are capable of elastically bending both away from and toward the horizontal center of foam 11 in a spring-like manner and for purposes explained hereinafter.

Figure 2:
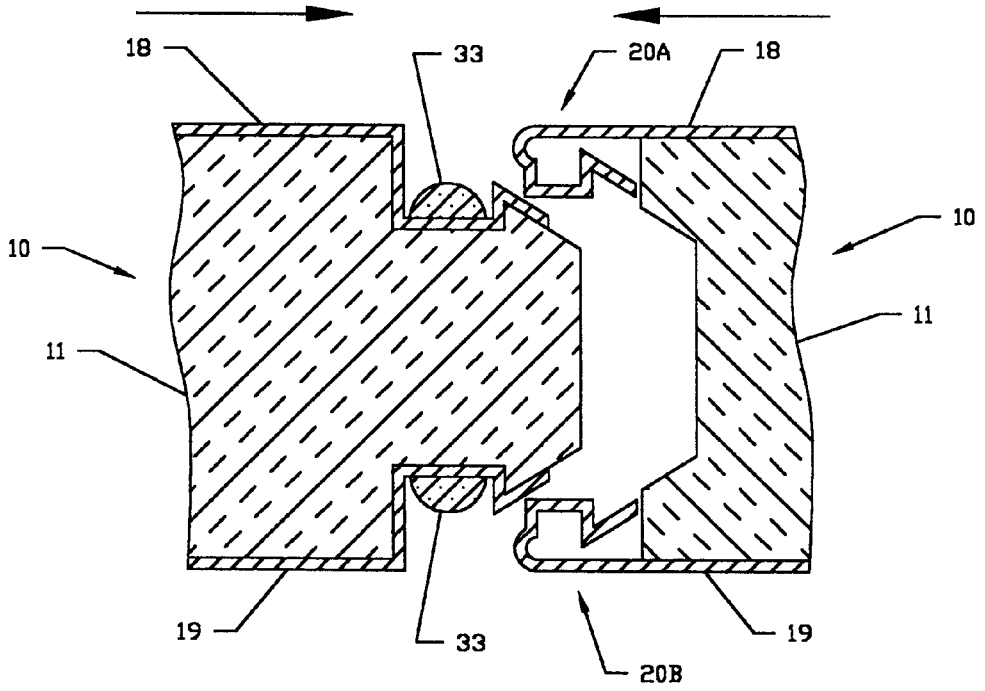
FIG. 2 is a partial front elevation of two foam cored construction panels in the process of being fitted together.
Figure 3:
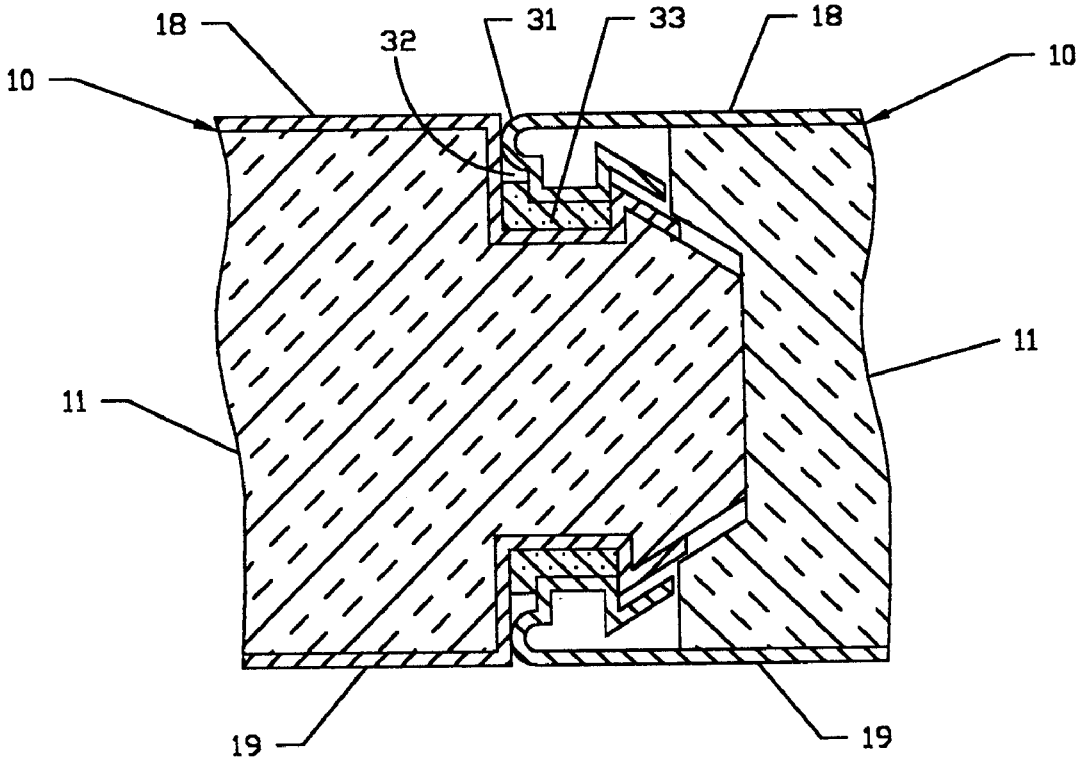
FIG. 3 is a partial front elevation view of two foam cored construction panels of FIG. 2 arranged side by side and joined together with a sealant within the formed end configurations according to one embodiment of the present invention.

FIG. 2 illustrates the adjacent ends of two side by side panels 10 being pushed together to form the joint shown in FIG. 3. The junction of edge portions 27 and 28 on ends 20A and 20B first contact the inclined surfaces of edge portions 25 on ends 21A and 21B. Further pushing causes the interaction of the contacting surfaces to resiliently bend ends 20A and 20B slightly outward due to the inclined configuration of edge portion 25 and over the junction of edge portions 24 and 25. Then ends 20A and 20B resiliently bend back to their original configuration but within the grooves 26 as shown in FIG. 3.

Ends 20A and 20B, and 21A and 21B are configured to provide a discrete "L" shaped space 32 between the mating ends when two adjacent panels 10 are fully pushed together as shown also in FIG. 3. Discrete spaces 32 provide the space necessary to fit there within a bead of a sealant 33 such as caulk. It is to be noted that the sealant 33 is applied to grooves 26 just prior to the assembly of two adjacent panels 10 as shown in FIG. 2. The resilient cantilever action of ends 20A and 20B push down on the bead of sealant 33 causing the same to spread out and fill the discrete space 32, and provide a weather tight seal between adjacent panels.

The extending curved end portions or protrusions 31 form stops which limit the amount of horizontal distance that ends 20A and 20B fit within ends 21A and 21B and/or limit the amount that the two side by side panels can be pushed together. Curved, protrusions 31 therefore limit the vertical side to side clearance of the formed edge between mating adjacent panels. Accordingly, the vertical portion of sealant space 32 is dependent upon the mating fit up of vertical edge portions 27 of ends 20 with vertical edge portions of 22 of ends 21 as dictated by the amount of distance that protruding portion 31 extends beyond edge portion 27. In this manner a more precise vertical portion of sealant space 32 results. It is simply a matter of pushing adjacent panels together until the ends 20A and 20B snap into place within grooves 26 and until protrusions 31 contact vertical edge portions 22 thereby limiting any further side travel. Moreover, the overall width of multiple, assembled side by side panels 10 may now be more closely controlled to provide a more accurate overall fit up at the construction site. The horizontal portion of the discrete sealant space 32 is controlled by a number of factors with one primary factor being the formed edge portions 23 and 28, i.e. the as formed distance between sail edge portions when two side by side panels are pushed together. Since edge portion 23 fits against a machined groove in the foam core, the location of edge portion 23 is very accurately fixed. While edge portion 28 is suspended from the planar surface of cladding 18 or 19, it comprises a portion which lends itself to relatively accurate positioning during forming operations. A properly sized horizontal portion of sealant space 32 is further provided by the mating fit-up of inclined surfaces 25 and 30. The mating fit up of inclined surfaces 25 and 30 provide a further benefit comprising the stabilization and centering of adjacent panels at the time of assembly and thereafter. That is, that the two side by side panels are positioned in the same horizontal plane with the top and bottom clad surfaces in substantial horizontal alignment and each inclined surface 30 limits the vertical motion of adjacent and joined panels due to interference with the inclined surface 25 or the opposite side of the joint. The result is that a desired, predetermined sized, sealant space is provided and the outer surfaces 18 and 19 of the panels 10 are properly aligned and stabilized when the panels are joined.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved.

What is claimed is:

1. A construction panel adapted to be joined to another construction panel comprising:

a foam planer member having a top surface and a bottom surface and opposite first and second side edges, a metallic planer member attached to each of said top and bottom surfaces of said foam member, each metallic member having a first formed end and a second formed end, each being located at opposite side ends of said metallic member, said first side edge of said foam member having a groove within said top surface and a groove within said bottom surface, said grooves extending along the length of said first side edge, said first side end of each of said metallic members being configured to fit within a respective one of said grooves with a first end portion thereof extending at an incline toward the other of said metallic members, said second side end of said metallic members extending from the second side edge of said foam member and configured complementary to said first side edge said metallic members and having a protrusion on a vertical surface thereof.

2. The construction panel of claim 1 including a second of said construction panels wherein said protrusion provides a vertical space between said first and said second formed ends of said metallic member when said panels are joined together.

3. The construction panel of claim 1 including a second of said construction panels wherein said complementary first and second formed end configurations of said metallic members each include a horizontal space therebetween when said panels are joined together.

4. The construction panels of claim 2 wherein said complementary formed first 2 and second end configurations of said metallic members each include a horizontal 3 space therebetween when said panels are joined together.

5. The construction panel of claim 4 wherein said complementary end configurations of said metallic members include a sealant material within said horizontal and vertical spaces.

6. The construction panels of claim 1 wherein said second ends of said metallic members each include a second inclined portion at an end thereof extending in a direction toward said second end of said foam member and toward the other of said metallic members, said first and second inclined portions closely spaced from each other comprising a panel stabilizer in a direction perpindicular to the plane of the panels when joined together.

* * * * *